US008034186B2

(12) United States Patent
Elfner et al.

(10) Patent No.: US 8,034,186 B2
(45) Date of Patent: Oct. 11, 2011

(54) METHOD FOR, AND APPARATUS FOR, CLEANING TUBES

(75) Inventors: Peter Elfner, Ergolding (DE); Martin Zoettl, Tiefenbach (DE)

(73) Assignee: Schott AG, Mainz (DE)

( * ) Notice: Subject to any disclaimer, the term of this patent is extended or adjusted under 35 U.S.C. 154(b) by 720 days.

(21) Appl. No.: 11/934,445

(22) Filed: Nov. 2, 2007

(65) Prior Publication Data

US 2008/0110475 A1 May 15, 2008

(30) Foreign Application Priority Data

Nov. 3, 2006 (DE) ..... 10 2006 052 256

(51) Int. Cl.
*B08B 9/02* (2006.01)

(52) U.S. Cl. ..... 134/22.11; 134/22.12; 134/33

(58) Field of Classification Search ..... 134/1, 22.1, 134/22.11, 22.12, 22.13, 22.14, 32, 33
See application file for complete search history.

(56) References Cited

U.S. PATENT DOCUMENTS

| | | | | |
|---|---|---|---|---|
| 2,256,663 | A * | 9/1941 | Brewer | 134/23 |
| 2,628,431 | A * | 2/1953 | Chapman | 34/58 |
| 3,291,640 | A * | 12/1966 | Livingston | 134/1 |
| 2005/0126624 | A1 | 6/2005 | Pellizzari | |
| 2008/0210262 | A1 * | 9/2008 | Lauzon | 134/22.12 |

FOREIGN PATENT DOCUMENTS

| | | | |
|---|---|---|---|
| DE | 600 17 950 | T2 | 1/2006 |
| GB | 2 388 562 | A | 11/2003 |
| KR | 1020050099709 | A | 10/2005 |

* cited by examiner

*Primary Examiner* — Michael Barr
*Assistant Examiner* — Saeed T Chaudhry
(74) *Attorney, Agent, or Firm* — DeMont & Breyer, LLC

(57) ABSTRACT

The invention relates to a method of cleaning tubes, in which the tube is at least partially filled with a cleaning medium, wherein a cleaning medium is atomized, in which case the droplets of cleaning medium are accelerated, at least in part, essentially in the direction of a center axis of the tube.

18 Claims, 6 Drawing Sheets

METHOD FOR, AND APPARATUS FOR, CLEANING TUBES

FIELD OF THE INVENTION

The invention relates to a method of cleaning tubes, in particular capillary tubes which are closed at one end, also known as scooping capillaries.

BACKGROUND OF THE INVENTION

Capillary tubes are required for a variety of different uses. For example, in the electronics sector, reed switches and transponders are welded in thin glass capillary tubes. In order for the function of such components, which in some cases are relevant to safety, not to be impaired, the cleanliness of the capillaries used has to meet stringent requirements.

The cleaning of capillary tubes, however, is an extremely difficult task. Thus, the cleaning medium, on account of the surface tension, is slow to penetrate into the capillaries and thus usually achieves an unsatisfactory cleaning result.

The cleaning of capillaries which are closed at one end, also known as scooping capillaries, poses particular problems. If such a scooping capillary is to be flooded with a cleaning medium, the cleaning medium usually penetrates only into the front region since the air which is enclosed in the region behind prevents the cleaning medium from passing through the entire volume of the capillary.

A series of methods are known for the purpose of cleaning capillaries.

Thus, for example, EP 1 237 665 discloses the operation of cleaning capillaries by means of a liquid which contains magnetic droplets. A significantly improved cleaning action is achieved by a changing magnetic field being applied.

DD 274 173 discloses a method of cleaning capillaries in which the capillary is cooled from outside in a nitrogen bath and a cryogenic liquid is forced through the capillary.

Also known in practice are mechanical methods in which a cleaning aid is forced through the capillary. Such mechanical methods, however, are not suitable for all types of capillaries. The known methods of cleaning capillaries involve extremely high outlay.

In particular the operation of cleaning scooping capillaries is possible only to an insufficient extent using methods which are known from the prior art.

OBJECT OF THE INVENTION

Accordingly, it is an object of the invention to provide a cleaning method and a cleaning apparatus, in particular for cleaning capillary tubes, which reduce the above-mentioned disadvantages of the prior art and allow straightforward and reliable cleaning.

In particular it is an object of the invention also to allow scooping capillaries to be cleaned to a sufficient extent.

It is a further object of the invention to provide a cleaning method in which there are no residues of cleaning medium remaining in a capillary which are harmful to the health or have an adverse effect on electronic components.

SUMMARY OF THE INVENTION

The object of the invention is achieved by a method of cleaning tubes and by a cleaning apparatus as claimed in one of the independent claims.

Preferred embodiments and developments of the invention can be gathered from the respective subclaims.

Accordingly, the invention provides a method of cleaning tubes, in particular of cleaning capillary tubes which are closed at one end, also known as scooping capillaries, in which the tube is at least partially filled with a cleaning medium.

Tubes are to be understood, within the meaning of the application, as all kinds of relatively thin tube, which need not necessarily have a round cross section. It is not necessary either for the tubes to be open at both ends. The tube which is to be cleaned may also be part of an assembly which comprises other, not necessarily tubular, constituent parts.

For cleaning purposes, a cleaning medium, expediently in liquid form, is atomized or sprayed finely such that droplets of cleaning medium are accelerated in the direction of an opening. In particular, the droplets of cleaning medium are accelerated in the direction of a center axis of the tube.

Atomization of the cleaning medium, in particular of a cleaning liquid, allows the droplets to penetrate into the tube without this resulting, reinforced by the surface tension of the cleaning medium, in the formation of a droplet which takes up the entire internal diameter of the tube and makes it difficult for the capillary to be filled further or, as is the case in particular with a scooping capillary, even prevents further filling.

It is thus possible for even a scooping capillary to be filled from the base up.

The droplets of cleaning medium here preferably have a smaller average diameter than the internal diameter of the tube. The internal diameter of the tubes is preferably between 0.7 and 11 mm.

Furthermore, it is made possible also to use cleaning media with a comparatively high surface tension, in particular water can be used for cleaning, for example, in a final flushing operation.

The tube is preferably filled with the cleaning medium up to at least 60%, preferably up to 70% and particularly preferably up to 80%, of its volume. The method according to the invention can even be used to fill a capillary completely without it having to be subjected to pressure from one end.

In a development of the invention, in at least one further step, the tube is partially filled by having an open end submerged in the cleaning medium. The inventors have found that an improved cleaning action can be achieved by alternating the operations of completely filling the tube with cleaning medium and partially filling it with cleaning medium.

This effect could be attributable to an improved cleaning action along boundary surfaces.

In order to achieve an optimum cleaning action, the tube is at least partially filled and emptied a number of times, in which case it is preferably completely and partially filled and emptied a number of times.

In a development of the invention, the cleaning medium is distributed in the completely or partially filled tube by virtue of the tube being moved.

In order to achieve optimum distribution, the movement of the tube comprises a rotation about at least one axis, preferably two axes. Rotation is to be understood, within the meaning of the application, as any movement similar to a rotary movement. It is not absolutely necessary here for the tube to be rotated through an entire revolution.

Provision is also made, in particular, within the meaning of the invention, to move the tube periodically back and forth.

In the case of a preferred embodiment of the invention, the rotary movement comprises a rotation about an axis which is spaced apart from the tube. Such a rotary movement, which may also comprise a periodic movement alternately in two directions, may be produced, for example, by a drum, on the lateral surface of which the tubes which are to be cleaned are arranged. The axis of rotation, that is to say the axis about which the rotary movement essentially takes place, does not intersect the tube here.

According to a development of the invention, the rotary movement about the axis of rotation which is spaced apart from the tube is combined with a rotary movement about at least one axis of rotation, preferably two axes of rotation which intersect the tube, or are located at least in the vicinity of the tube.

The rotation about the axis which is spaced apart from the tube makes it possible for the cleaning medium to be subjected to high centrifugal forces. The rotation of the tube itself by rotation about an axis which intersects the tube makes it possible, in combination, for the cleaning medium to be accelerated alternately in different directions and thus to achieve an improved cleaning action. It is thus possible for the tube to be alternately filled with cleaning medium and emptied again.

In particular, by virtue of rotary movements being combined, the tube is made to execute a tumbling movement, at least at certain times, in order to distribute the cleaning medium. The tumbling movement here may be executed such that the cleaning medium located in the tube has a preferred direction, that is to say moves in one direction within the tube. Depending on the method embodiment, however, it is also possible to dispense with the tumbling movement.

In the case of a development of the invention, the tube is emptied by a rotary movement in which an open end of the tube is oriented essentially radially away from the axis of rotation. In particular provision is made for the tube to be rotated along an axis of rotation which runs through the tube or is in the vicinity of the tube, in which case the open end is oriented outward, whereas for example a drum in which the tube is suspended rotates, as a result of which the cleaning medium is accelerated in the direction of the opening.

It is particularly advantageous for the cleaning and emptying of the tube if, during emptying, the tube is rotated, at least at certain times, about a further axis.

In particular it has been found that reliable emptying of scooping capillaries can be achieved if the tube, which has its open side oriented away from the axis of rotation of a drum, is made to execute a tumbling movement by a combined rotary movement about two further axes.

The sum of the forces acting on the cleaning medium here is directed preferably essentially radially away from the spaced-apart axis of rotation.

In the case of a development of the invention, at least in a final flushing operation, use is made of a hot cleaning medium, in particular a cleaning medium with a temperature of over 50° C., preferably 70° C.

By using a hot cleaning medium, in particular hot water, it is possible to introduce thermal energy, which results in the tube being heated and thus being dried after emptying. It is therefore possible to avoid the situation where the tubes have to be heated up again following the cleaning operation.

The cleaning medium used is preferably an aqueous, acidic or alkaline liquid.

Furthermore, an alternative to the invention relates to a method of cleaning tubes in which a tube is submerged in a cleaning liquid at least by way of an open end, and the tube is moved in at least one direction in space in order to distribute the cleaning medium.

According to this alternative embodiment of the method, cleaning liquid is introduced into the tube on account of the capillary action. The cleaning medium is distributed by virtue of movement.

This embodiment of the method is particularly straightforward and can be combined with one or more steps of the first alternative described above. In particular provision is made to move the tube in accordance with one or more steps of the first variant of the invention, and thus to distribute the cleaning medium.

Provision is also made for the tube, in particular a scooping capillary, to be alternately partially filled and completely filled by being submerged.

The method according to the invention makes it possible to provide tubes which, in their interior, have, on average, fewer than 10, preferably fewer than 5 and particularly preferably fewer than 2, droplets of a size of more than 0.5 μm.

The invention makes it possible for tubes to be cleaned effectively such that a batch of 250 000 tubes has fewer than 1000, preferably fewer than 500, particularly preferably fewer than 10, particles of a size of over 100 μm, preferably over 50 μm and particularly preferably over 20 μm. Such relatively large particles, in particular glass particles, may cause particularly serious disruption in electronic components. In particular, a reed relay may be blocked by the particles, in which case it is not possible to make any contact.

The invention further relates to a cleaning apparatus, in particular for implementing a method according to the invention and in particular for cleaning scooping capillaries.

The cleaning apparatus comprises at least one container for accommodating a cleaning medium, and also a drum with an accommodating chamber for accommodating articles which are to be cleaned.

The cleaning apparatus also comprises means for the purpose of rotating the drum, as well as at least one accommodating device which is arranged in the drum and is intended for accommodating at least one article which is to be cleaned, the accommodating device, for its part, comprising means for the purpose of rotating the article about at least one axis.

By means of the cleaning apparatus, the article which is to be cleaned, in particular a capillary, can be made to execute, by means of the drum, a rotary movement by way of which a cleaning medium which is located in or on the article which is to be cleaned is accelerated radially outward and thus, following one or more flushing operations, removed.

In the case of a development of the invention, the cleaning apparatus has means for the purpose of atomizing cleaning medium, in particular demineralized water, starting essentially from the center axis. By virtue of the cleaning medium being accelerated from the center axis in the direction of the article which is to be cleaned, good filling can be achieved in particular in the case of closed capillaries.

In order further to assist the removal of the cleaning medium, in particular if, on account of a capillary action, cleaning medium is drawn into gaps of the article which is to be cleaned, the article can be rotated about at least one further axis.

Provision is made, in particular, for the article to be rotated about at least two axes. This may comprise, for example, a periodic back and forth movement through a certain angle.

It is also the case, however, that combining the movements about axes of rotation described above is suitable not just for removing the cleaning medium, but also for distributing the same.

The accommodating device here is arranged essentially on the outer periphery of the drum.

In order to execute a method in which in particular scooping capillaries are completely filled, a development of the invention comprises at least one spray nozzle for atomizing a cleaning medium.

This spray nozzle is preferably directed essentially radially away from the axis of rotation, in which case the cleaning medium which is passing out, or the droplets of cleaning medium which is passing out, is or are accelerated essentially radially outward in the direction of the article which is to be cleaned.

A preferred embodiment of the invention comprises accommodating devices for a plurality of articles which are to be cleaned. Depending on the size and quantity of articles which are to be cleaned, it is possible here for a single accommodating device to comprise a plurality of mounts for articles which are to be cleaned, for example capillaries. However, provision is also made, within the meaning of the invention, to arrange, in the drum, a plurality of accommodating devices which comprise one or more individual mounts for individual articles which are to be cleaned.

DESCRIPTION OF THE DRAWINGS

The invention will be explained in more detail hereinbelow with reference to FIGS. 1 to 6 of the drawings, in which.

DETAILED DESCRIPTION OF PREFERRED EXEMPLARY EMBODIMENTS

Figure 1:
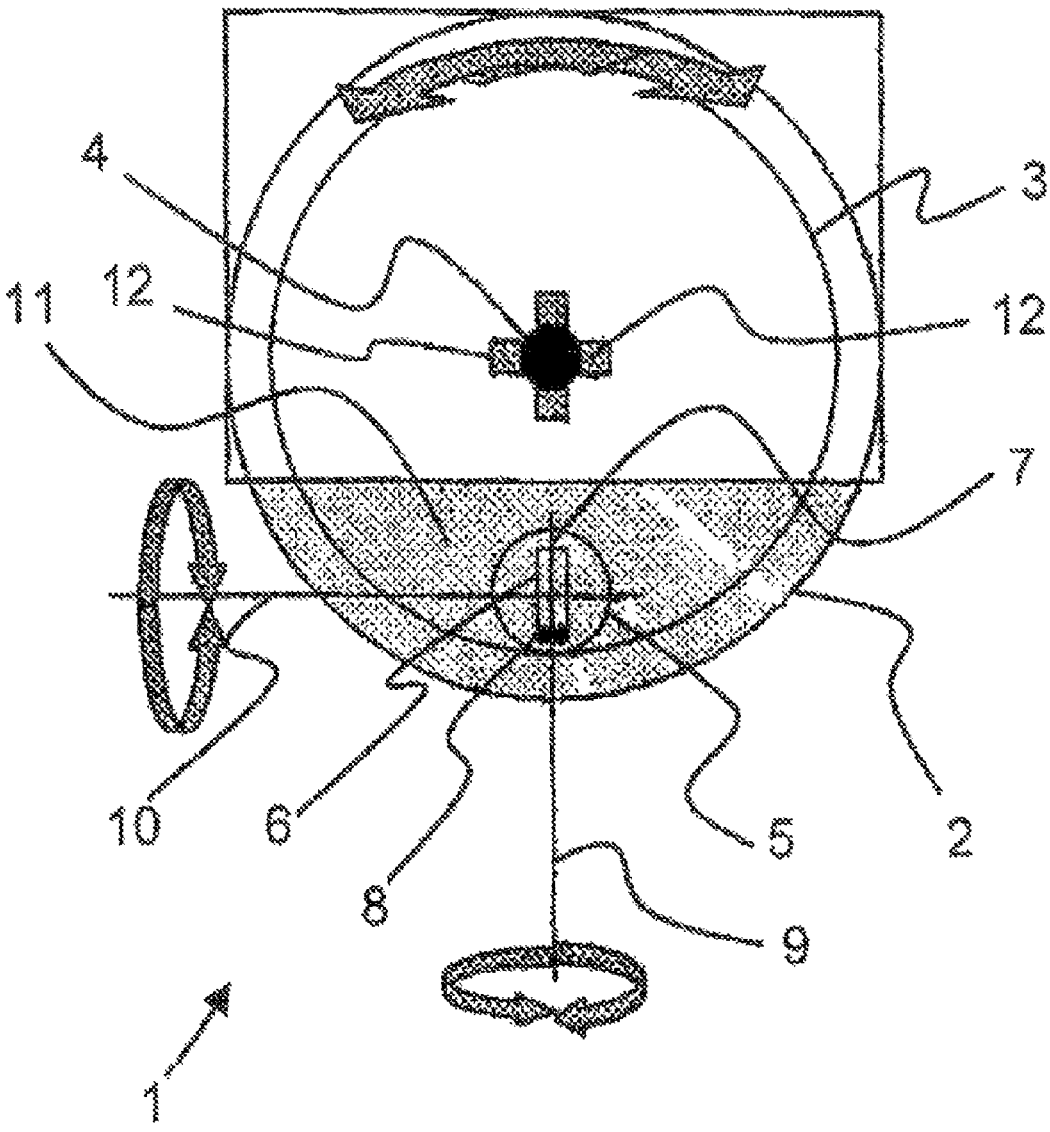
FIG. 1 shows, schematically, the essential elements of a cleaning apparatus according to the invention.

FIG. 1 will be used to explain in more detail the essential components of a cleaning apparatus according to the invention, in particular designed for implementing a method of cleaning tubes according to the invention. The cleaning apparatus 1 comprises a container 2 for accommodating a cleaning medium 11, and also comprises a drum 3. The drum 3 can be rotated about a bearing 4, the position of which corresponds to the axis of rotation, in both directions of rotation, indicated by two arrows in the top region.

In order for the cleaning medium 11 to be able to penetrate into the drum 3, the drum 3 is provided on its outside, at least in part, with apertures (not illustrated).

Arranged essentially on the periphery of the drum 3 is an accommodating device 5 which, in this exemplary embodiment, contains a capillary 6, in this case in the form of a scooping capillary.

The accommodating device 5 preferably comprises a perforated plate which is intended for accommodating a plurality of capillaries (not illustrated) and can be inserted into a magazine holder of the drum (not illustrated).

The accommodating device 5, and thus the scooping capillary 6, can be rotated, independently of the drum 3, along two axes of rotation 9, 10.

It is thus possible for the capillary 6, which in this case has its closed end 8 oriented away from the bearing 4 of the drum 3, to be positioned as desired relative to the drum 3. Thus, for example, the open end 7 of the capillary 6 can be rotated outward by a 180°-rotation about the axis of rotation 10.

The container, in this view, is partially filled with cleaning medium 11, and the accommodating device 5 with the capillary 6 has been fully submerged in the cleaning medium 11. In order to spray cleaning medium in the drum 3, the cleaning apparatus 1 has four spray nozzles 12, which are arranged essentially in the center of the cleaning apparatus 1 and are directed essentially radially outward. By means of such cleaning nozzles, the cleaning medium 11 can be atomized and, in the process, is accelerated essentially outward, that is to say in the direction of the drum wall 3.

Figure 2:
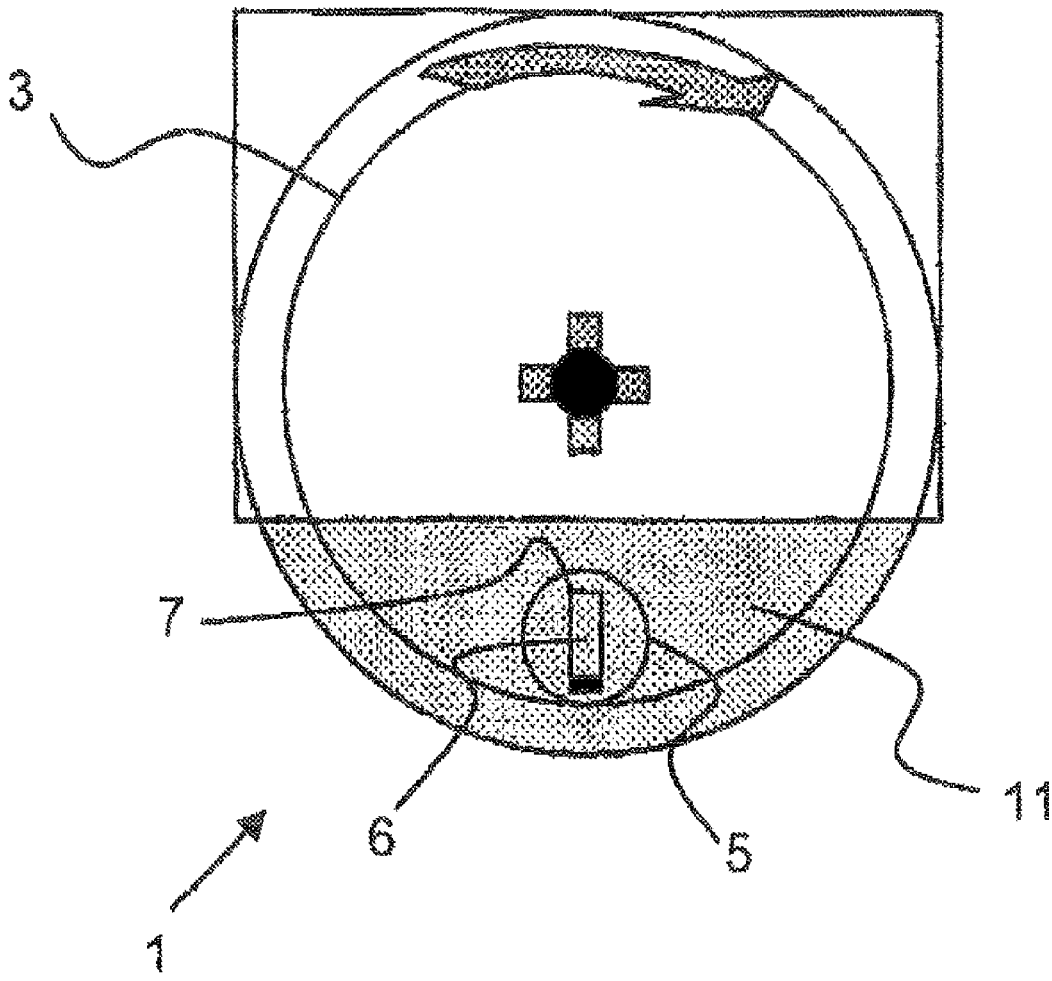
FIG. 2 shows, schematically, a view of a cleaning apparatus which will be used to explain in more detail the operation of partially filling scooping capillaries.

FIG. 2 will be used to explain in more detail the operation of partially filling a scooping capillary. For this purpose, the drum 3 is partially filled with cleaning medium 11.

The drum 3 executes a rotary movement, in which case the capillary 6 arranged in the accommodating device 5 is submerged in the cleaning medium 11. On account of the capillary action, cleaning medium penetrates into the capillary 6 at the open end 7 of the capillary 6. The volume of air which is located in the capillary 6 means that the capillary 6 is only partially filled. Although the open end 7 of the capillary 6 is oriented upward, the volume of air, on account of the surface tension, cannot escape.

Figure 3:
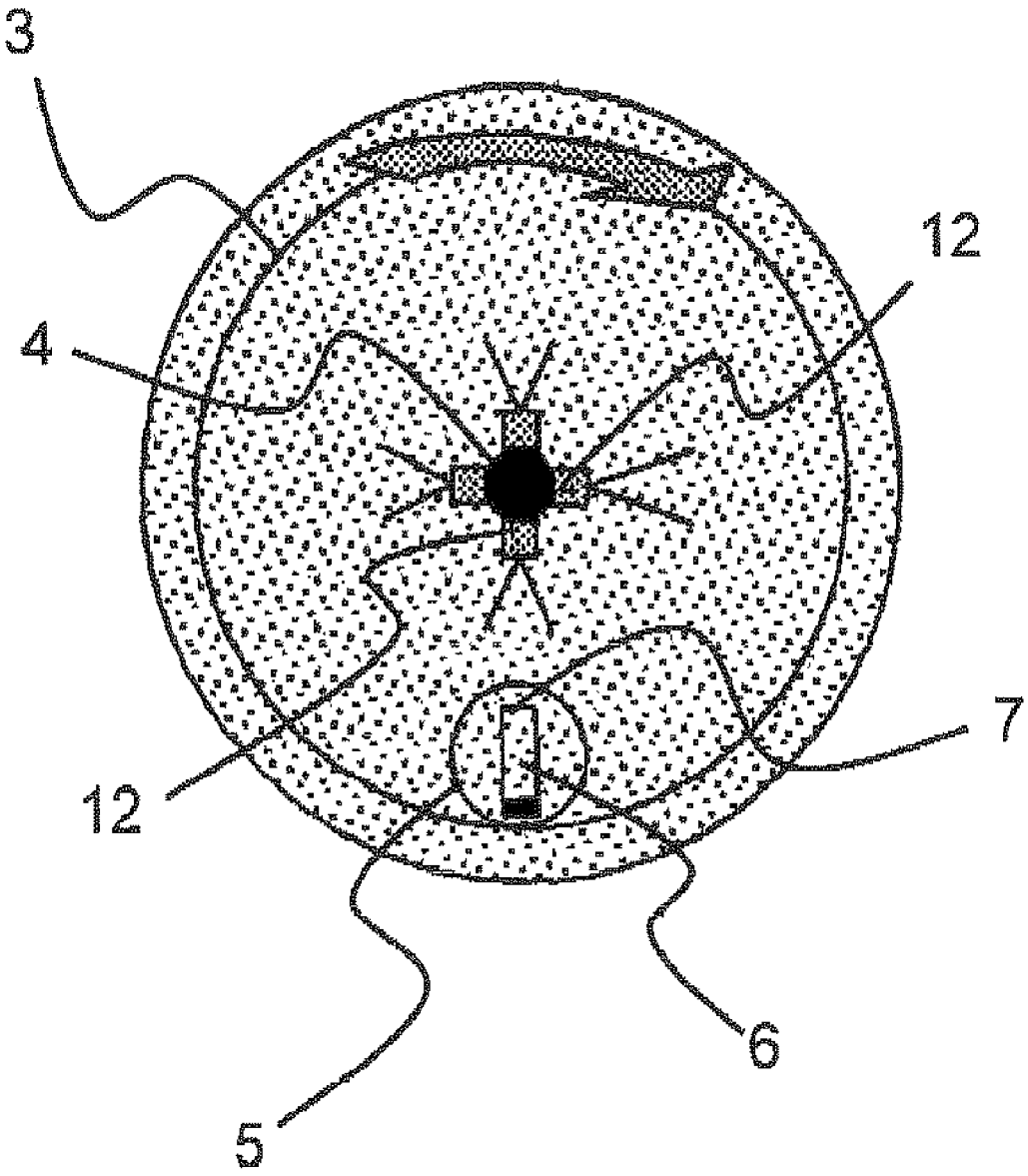
FIG. 3 shows, schematically, a view of a cleaning apparatus which will be used to explained in more detail the operation of completely filling scooping capillaries.

FIG. 3 will be used to explain in more detail, schematically, the operation of completely filling a scooping capillary 6. In this case, the drum 3 has not been flooded with cleaning medium 11. The scooping capillary has its open end 7 oriented essentially in the direction of the drum axis 4. Cleaning medium is distributed in the drum 3 via spray nozzles 12. At the same time, the drum rotates continuously in one direction. The droplets of cleaning medium move preferably away from the drum axis 4. The fine droplets can reach the base of the scooping capillary 6, as a result of which complete, or at least more or less complete, filling is made possible.

Figure 4:
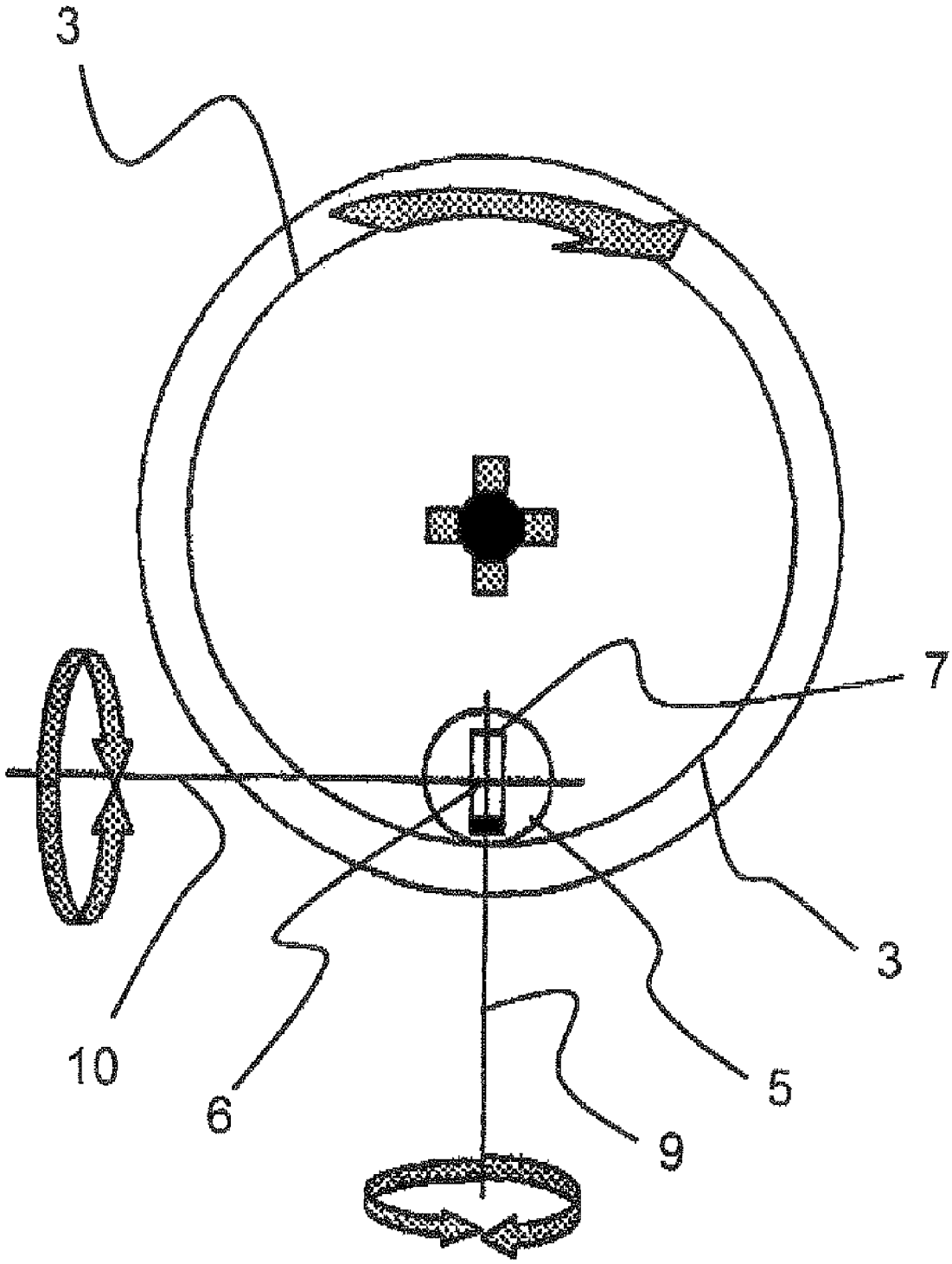
FIG. 4 shows, schematically, a view of a cleaning apparatus according to the invention which will be used to explain in more detail the operation of distributing a cleaning medium in a scooping capillary.

FIG. 4 will be used to explain in more detail the operation of distributing the cleaning medium. The scooping capillary 6 is at least partially filled with cleaning medium and is still retained in the accommodating device 5. As the drum 3 executes an essentially continuous rotary movement, the scooping capillary 6 is made to execute a tumbling movement via a periodic back and forth movement along the axes of rotation 9 and 10. The tumbling movement here is executed such that the sum of forces acting on the cleaning medium which is located in the capillary is oriented essentially in the direction of the base of the scooping capillary 6. The cleaning medium thus does not pass out of the capillary. However, the cleaning medium is distributed in the capillary by the alternating forces which act on the cleaning medium.

Figure 5:
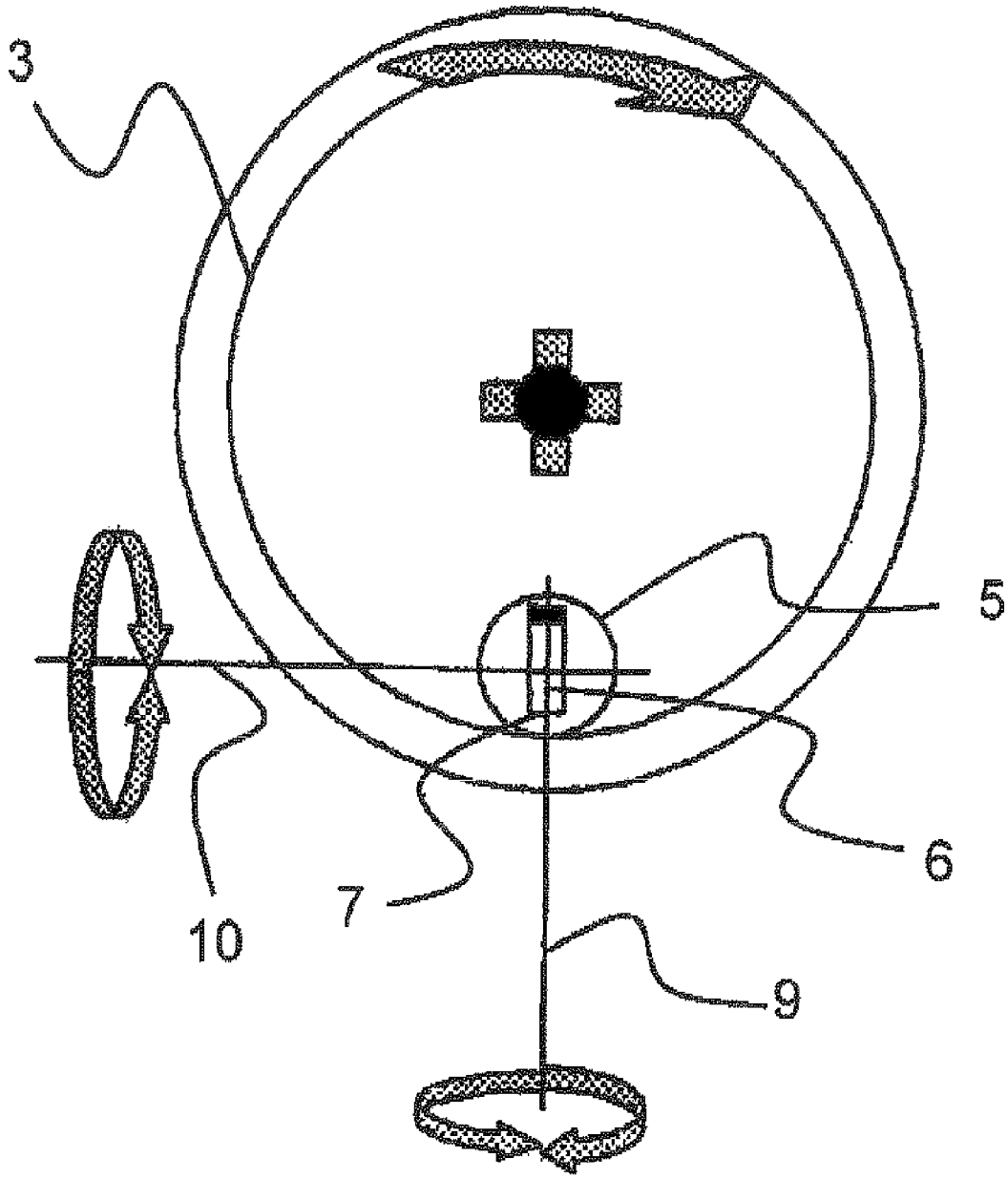
FIG. 5 shows, schematically, a view of a cleaning apparatus according to the invention which will be used to explain in more detail the operation of emptying a scooping capillary.

FIG. 5 will be used to explain the operation of emptying the scooping capillary. Here too, the drum 3 executes an essentially continuous rotary movement. The scooping capillary 6, then, is also made to execute a tumbling movement via a continuous back and forth movement along the axes of rotation 9 and 10. This tumbling movement here, however, is executed such that the open end is preferably directed essentially outward. The sum of the forces acting on the cleaning medium which is located in the capillary 6 is directed outward. Combining the rotary movement about the drum axis and the tumbling movement makes it possible to empty even relatively thin capillaries.

An optimum cleaning action is achieved by executing the complete filling and partial filling steps a number of times.

In a final flushing operation, provision is made for a hot cleaning medium to be used, as a result of which the capillary is heated up and any residual cleaning medium located on the walls of the capillary evaporates.

Figure 6:
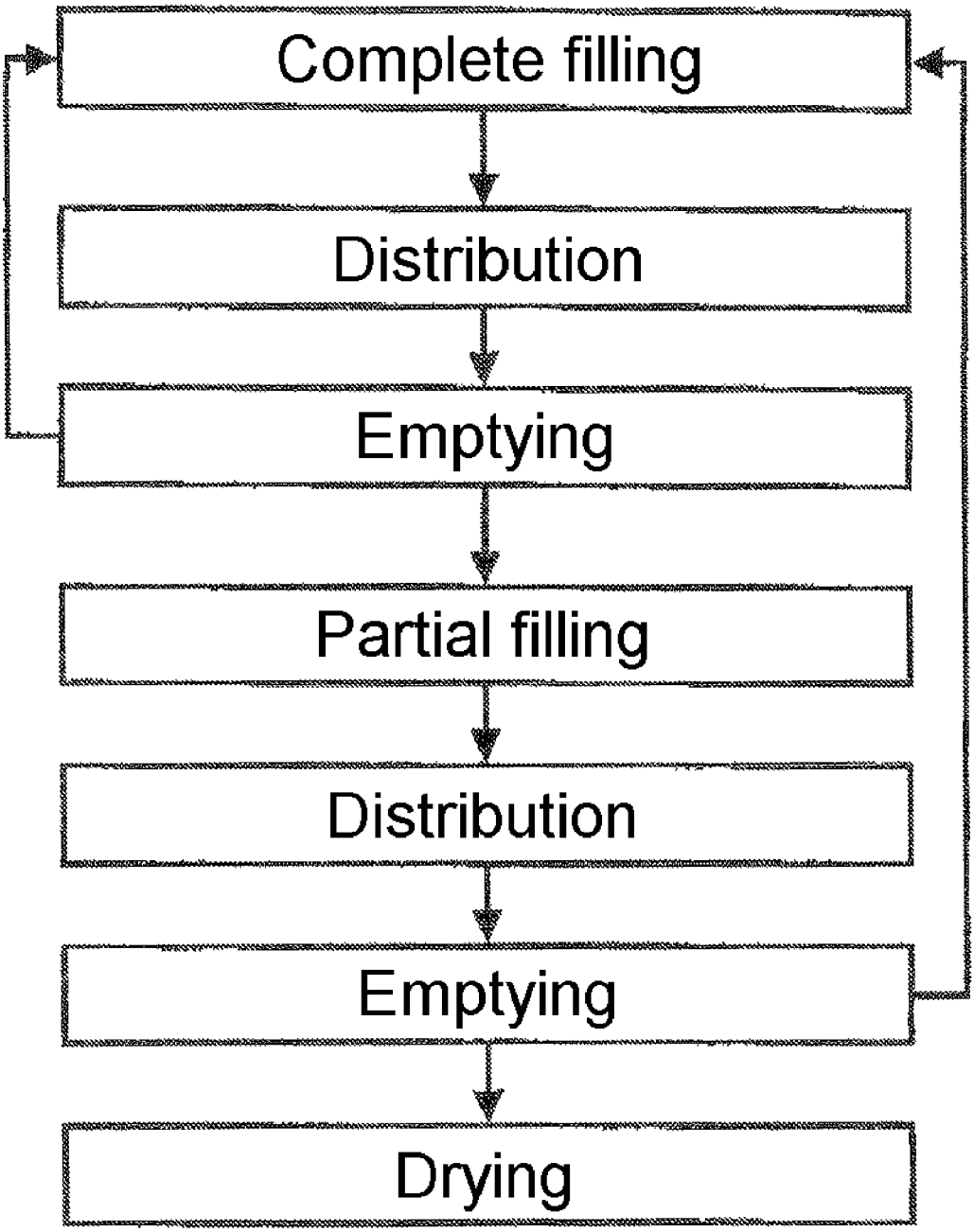
FIG. 6 shows, schematically, a flow diagram of a method of cleaning capillaries according to the invention.

The flow diagram in FIG. 6 will be used to give a brief illustration of the essential steps of an exemplary embodiment of a cleaning method according to the invention.

In a first step, the capillary is completely filled by virtue of a cleaning medium being atomized.

By virtue of a tumbling movement combined with a rotary movement, the cleaning medium is distributed, and the capillary is then emptied. The complete filling, distributing and emptying steps can be executed a number of times in succession.

In combination with being completely filled a number of times, the capillary is partially filled a number of times, the cleaning medium is distributed and the capillary is emptied again.

In a final step, the capillary is dried. The drying operation can be executed in a final flushing operation, for example, by flushing with a hot cleaning medium, in particular demineralized water.

It goes without saying that the order of the complete-filling steps can be changed over as desired.

It also goes without saying that, rather than the invention being limited to a combination of features described above, the person skilled in the art will combine individual features, or a number of features, of the invention as desired should this prove to be expedient.

LIST OF DESIGNATIONS

1 Cleaning apparatus
2 Container
3 Drum
4 Bearing
5 Accommodating device
6 Capillary
7 Open end
8 Closed end
9 First axis of rotation
10 Second axis of rotation
11 Cleaning liquid
12 spray nozzles

The invention claimed is:

1. A method of cleaning tubes comprising:

filling, at least partially, a tube with a cleaning medium; and atomizing the cleaning medium via a spray nozzle, such that droplets of the cleaning medium that result are accelerated, at least in part, essentially in the direction of an opening of the tube, wherein the tube and spray nozzle are spaced apart from each other by a gap.

2. The method of cleaning tubes as claimed in claim 1, wherein the tube is filled with the cleaning medium up to at least 60% of the volume of the tube.

3. The method of cleaning tubes as claimed in claim 1, wherein the cleaning medium is atomized such that the average diameter of the droplets is smaller than the internal diameter of the tube.

4. The method of cleaning tubes as claimed in claim 1, further comprising partially filling the tube by having an open end submerged in the cleaning medium.

5. The method of cleaning tubes as claimed in claim 1, wherein the tube is at least partially filled and emptied multiple times.

6. The method of cleaning tubes as claimed in claim 1, wherein the cleaning medium is distributed because of the tube being moved.

7. The method of cleaning tubes as claimed in claim 1, wherein the tube is rotated about at least one axis.

8. The method of cleaning tubes as claimed in claim 1, wherein the tube is rotated about an axis of rotation which is spaced apart from the tube.

9. The method of cleaning tubes as claimed in claim 1, wherein the tube is rotated such that a rotation about an axis which is spaced apart from the tube is combined with at least one rotation about an axis which runs through the tube or is in the vicinity of the tube.

10. The method of cleaning tubes as claimed in claim 1, wherein the tube is made to execute a tumbling movement, at least at certain times, in order to distribute and/or empty the cleaning medium.

11. The method of cleaning tubes as claimed in claim 1, wherein the tube is emptied by a rotary movement in which an open end of the tube is oriented essentially radially away from the axis of rotation that corresponds to the rotary movement.

12. The method of cleaning tubes as claimed in claim 11, wherein, during emptying, the tube is rotated about at least one further axis.

13. The method of cleaning tubes as claimed in claim 1, wherein demineralized water is used in at least one flushing operation.

14. The method of cleaning tubes as claimed in claim 1, wherein the surface tension of the cleaning medium is reduced by adding an alkali or acid.

15. The method of cleaning tubes as claimed in claim 1, wherein, at least in a final flushing operation, use is made of a cleaning medium with a temperature of over 50° C.

16. The method of cleaning tubes as claimed in claim 1, wherein the cleaning medium used is an aqueous, acidic or alkaline liquid.

17. The method of cleaning tubes as claimed in claim 1, wherein the tube is open at both ends during the atomizing, and the method further comprising closing the tube at at least one end subsequent to the atomizing.

18. The method of cleaning tubes as claimed in claim 1, further comprising:

submerging the tube in the cleaning medium at least by way of an open end; and moving the tube in at least one direction in space in order to distribute the cleaning medium.

* * * * *